US005582268A

United States Patent [19]

Heberlein

[11] Patent Number: 5,582,268

[45] Date of Patent: Dec. 10, 1996

[54] SAFETY PLATFORM

[76] Inventor: Richard M. Heberlein, 37755 County Rd. 18, Wray, Colo. 80758

[21] Appl. No.: 591,861

[22] Filed: Jan. 25, 1996

[51] Int. Cl.[6] ..... A47L 3/02

[52] U.S. Cl. ..... 182/113; 182/115; 182/116; 182/152; 182/156

[58] Field of Search ..... 182/152, 156, 182/113, 115, 116; 248/463, 464

[56] References Cited

U.S. PATENT DOCUMENTS

| | | | |
|---|---|---|---|
| 652,948 | 7/1900 | Barth | 182/113 |
| 701,532 | 6/1902 | Bardin | 182/113 |
| 917,576 | 4/1909 | Fornari | 182/113 |
| 1,235,711 | 8/1917 | Marinaro | 182/113 |
| 1,439,388 | 12/1922 | Willett | 182/152 |
| 1,439,389 | 12/1922 | Willett | 182/113 |
| 1,439,419 | 12/1922 | Jacobs | 182/113 |
| 2,172,860 | 9/1939 | Weaver | 182/113 |
| 3,127,953 | 4/1964 | Shore | 182/156 |
| 4,503,932 | 3/1985 | Hilton | 182/152 X |

FOREIGN PATENT DOCUMENTS

| | | | |
|---|---|---|---|
| 1257779 | 2/1961 | France | 182/156 |
| 2627533 | 8/1989 | France | 182/152 |

*Primary Examiner*—Ramon O. Ramirez
*Assistant Examiner*—Michael J. Turgeon
*Attorney, Agent, or Firm*—Rick Martin

[57] ABSTRACT

The present invention relates to a safety platform having a large platform with a high friction surface. Surrounding and supporting the platform are four legs. Located at the upper ends of the legs are two lateral guard rails and a front guard rail. The rear of the platform is open for user entry. The rear legs have longitudinal slots to accommodate a linkage extending from each rear corner of the platform to the rear of each lateral guard rail. The user may fully fold the safety platform by lifting the rear of the platform, thereby causing the invention to fold to a relatively narrow configuration for easy storage.

12 Claims, 1 Drawing Sheet

SAFETY PLATFORM

FIELD OF INVENTION

The present invention relates to a safety platform which comprises a platform of sufficient size to allow the user to move about to adjust his/her position and which comprises a guardrail enclosing the user on three sides allowing the user to safely perform various tasks from the platform. The present invention may be folded in order to be stored in narrow spaces.

BACKGROUND OF THE INVENTION

The use of ladder-type equipment to allow a user to reach elevated locations is well known. Generally, the means for reaching elevated objects ranges from inverted buckets, boxes, step-ladders, chairs, scaffolds, and so on. Also available are platforms which are electrically or mechanically extended upward. These means are simply placed in a position near the object of interest. The user then extends, steps on, or climbs up the means.

These means of reaching objects are at times either unsuited for use in the location of interest, or they place the user in an inherently unstable and dangerous position. For example, the user may find himself/herself stepping on the top rung of a ladder or using a box or inverted bucket which may be too short to reach the desired object. Further, the means may be too large for reaching an area only a slight distance above the user's head. The instability and danger to the user may also result from overreaching from a means which offers no stability or an insufficiently large platform from which to work.

There remains a need for a safety platform for changing ceiling light bulbs, painting, etc., which; 1) provides a platform which is sufficiently large to allow the user to move about while working; 2) provides a guard rail at approximately waist height to prevent the user from falling off the safety platform; 3) provides sure footing for the user; 4) folds to allow storage in narrow spaces; or 5) is sufficiently compact to be used in relatively confined areas. The present invention addresses all five requirements by using a four-legged design having a high friction checker plate platform with integral guard-rail.

SUMMARY OF THE INVENTION

The primary object of the present invention is to provide a safety platform which has a wide platform from which to work and having an integral guard rail.

Another object of the present invention is to provide a means of folding the safety platform to fit in narrow spaces.

Another object of the present invention is to provide a safety platform constructed of durable light-weight material to assure a long service life.

Another object of the present invention is to provide a safety platform which may be easily used by users of diverse physical capabilities.

Another object of the present invention is to provide a safety platform with a plurality of widely spaced legs to enhance its stability on various uneven surfaces.

Other objects of this invention will appear from the following description and appended claims, reference being made to the accompanying drawings forming a part of this specification wherein like reference characters designate corresponding parts in the several views.

The present invention consists of a platform. From the front of the platform two legs extend approximately normally to the ground. From the rear of the platform two legs extend to the ground at an angle to the normal. The rear legs each have a slot within which a pin attached to the rear of the platform may slide for folding. Each pin is attached to the respective rear corner of the platform, extended through the slot in the rear leg and attached to the lower end of a linkage. The linkages extend vertically from the rear corners of the platform from each corner. The linkages extend to and support the lateral guard rails. The lateral guard rails consist of handrails linked to the upper end of each of the two linkages, extending to each of the two front legs as well as between the two front legs. The guard rails are arranged in such a manner so as to form a three-sided enclosure around the user at waist height. The open fourth side between the two rear legs is for entry of the user. Between the two rear legs below the elevation of the platform are steps allowing the user to step from the ground up to the platform.

In order to fold the safety platform the user simply lifts the rear of the platform while holding one of the linkages. As the rear of the platform is lifted the pins in the rear corners of the platform slide within the slots in the rear legs, thereby allowing the platform to rotate about pins in the front corners while also rotating upward into a position parallel with the front legs. This lifting motion also causes the rear legs to pivot about the pivot point of each on each guard rail. The rear legs pivot to a position adjacent and parallel to the platform. This motion also causes the linkage to move upward with the rear of the platform, thereby raising the rear of the lateral guard rails to a position parallel with the front and rear legs.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 1:
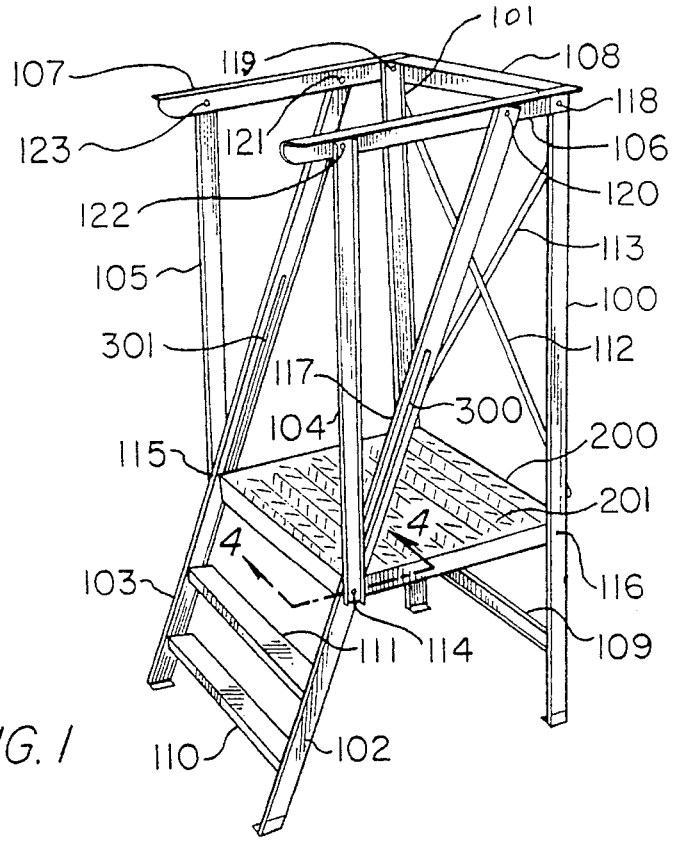
FIG. 1 a side perspective view depicting the invention in the unfolded position ready for use.

Referring first to FIG. 1 a side perspective depicts the preferred embodiment of the unfolded safety platform. This embodiment has the minimal parts necessary to practice the invention. Rectangular platform 200 has front legs 100, 101 attached by fasteners 116, 117. Fasteners 116, 117 are medially located in each front leg and fasten to each front corner of the platform 200. The platform 200 has a high friction surface 201 for providing a sure footing to the user. Between each front leg 100, 101 are cross braces 112, 113. Front leg brace 109 is attached between front legs 100, 101 and below the elevation of the platform 200. The front guard rail 108 is attached between each front leg 100 and 101. Each rear leg 102, 103 is slidingly attached by pins 114 and 115 respectively, to each rear corner of said platform 200.

Also attached to each pin 114 and 115 is the lower end of each linkage 104 and 105 respectively. Each pin 114, 115 is in turn immovably attached to each rear corner of the platform 200. The pins 114, 115 are slidingly inserted through each slot 300 and 301 in rear leg 102 and 103 respectively, and rotationally attached to the lower end of each linkage 104 and 105 respectively.

Steps 110 and 111 are attached between each rear leg 102 and 103 below the elevation of the rectangular platform 200.

Each upper end of each linkage 104 and 105 is rotatingly attached to the proximal end of each lateral guard rail 106 and 107 by pins 122 and 123 respectively. The distal end of each lateral guard rail 106, 107 is rotatingly attached to the upper end of each front leg 100 and 101 by pins 118 and 119 respectively. Each upper end of each rear leg 102, 103 is rotatingly attached to the medial section of each lateral guard rail 106, 107 by pins 120 and 121 respectively.

Figure 4:
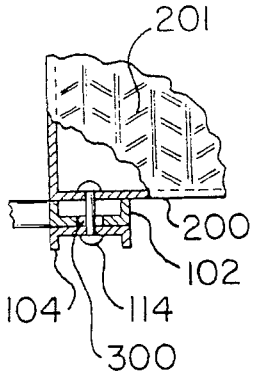
FIG. 4 is a cross-sectional view taken along line A—A of FIG. 1 of the sliding fastener between the rear corners of the platform to the rear legs and lateral guard rail linkage.

Referring next to FIG. 4 the sliding attachment between the platform 200, the linkage 104, and rear leg 102 is depicted. The pin 114 is immovably attached to a rear corner of the platform 200. Pin 114 is slidingly inserted through the slot 300 in rear leg 102 and is rotatingly attached to the linkage 104. This construction allows the pin 114 to slide within the slot 300 while the safety platform is being folded. This depiction also applies to the configuration about pin 115.

Figure 2:
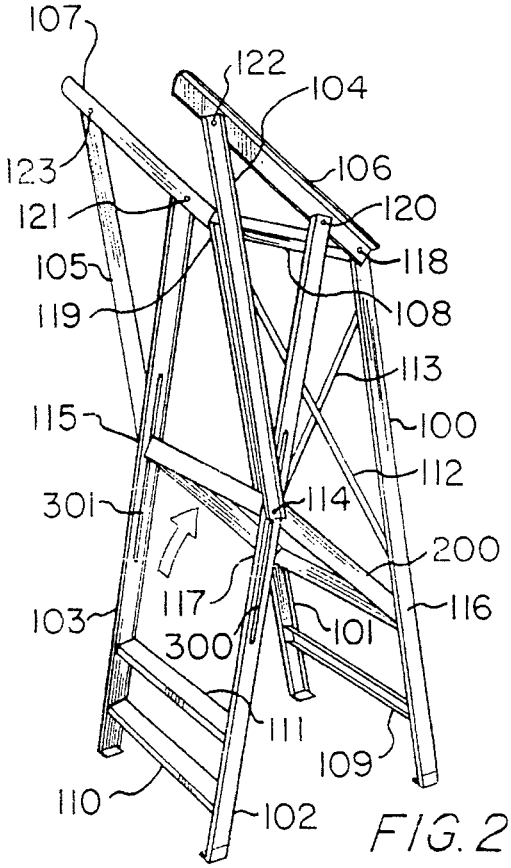
FIG. 2 is a side perspective view depicting the invention in the semi-folded position showing the relative movement of the parts during folding.

Referring next to FIG. 2 the manner of folding the invention is depicted. The user (not shown) begins by grasping either linkage 104 or 105 and then grasping with his/her other hand (not shown) the rear edge of the platform 200. The user then lifts the rear edge of the platform 200 while stabilizing the invention by grasping the linkage 104 or 105. As the present invention folds each pin 114 and 115 slidingly moves in each slot 300 and 301 respectively. This motion of pin 114 and 115 also causes each linkage 104 and 105 to move upward, thereby lifting each lateral guard rail 106 and 107 respectively.

As each lateral guard rail 106 and 107 lifts, each also rotates about each pin 118 and 119.

As the platform 200 rises, it rotates about fastener 116 and 117.

Figure 3:
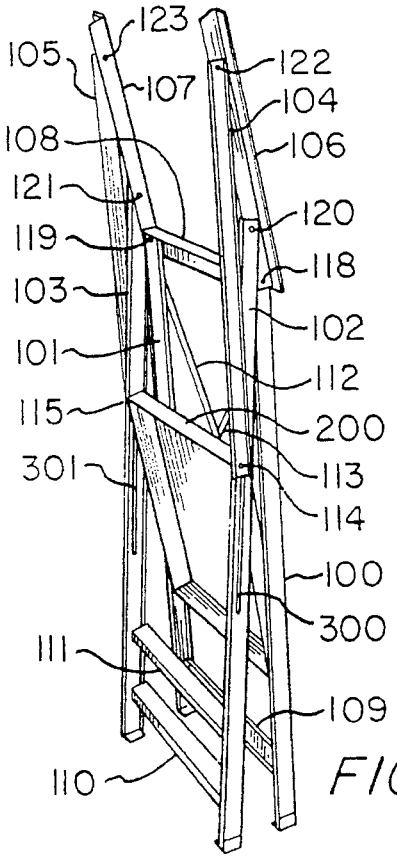
FIG. 3 is a side perspective view depicting the invention in the fully folded position showing the relative positions of the parts once folded for storage.

Referring last to FIG. 3 the invention is depicted in its fully folded position. The linkage 104 and 105 is essentially parallel to each rear leg 102 and 103, the platform 200, and each front leg 100 and 101. Each lateral guard rail 106 and 107 is also essentially parallel to the foregoing elements. This allows the fully folded invention to be stored in a narrow space when not in use.

Although the present invention has been described with reference to preferred embodiments, numerous modifications and variations can be made and still the result will come within the scope of the invention. No limitation with respect to the specific embodiments disclosed herein is intended or should be inferred.

KEY

100 Front leg
101 Front leg
102 Rear leg
103 Rear leg
104 Linkage
105 Linkage
106 Lateral Guard Rail
107 Lateral Guard Rail
108 Front Guard Rail
109 Front Leg Brace
110 Step
111 Step
112 Cross Brace
113 Cross Brace
114 Pin
115 Pin
116 Fastener
117 Fastener
118 Pin
119 Pin
120 Pin
121 Pin
122 Pin
123 Pin
200 platform
210 High Friction Surface
300 Slot
301 Slot

I claim:

1. A folding, portable stepladder/platform assembly comprising:

a safety platform pivotally supported by a pair of front legs and a pair of rear legs;

said rear legs having-slots for a sliding connection to a pair of rear sides of said safety platform;

a pair of lateral guard rails having a pivotal connection to a top segment of each of said pair of front and rear legs; and a front guard rail connected between said pair of front legs.

2. The assembly of claim 1, wherein said pair of rear legs further comprise steps leading to the safety platform and each has a vertical linkage supporting said lateral guard rails.

3. The assembly of claim 2, wherein said safety platform further comprises a high-friction surface.

4. The assembly of claim 3 further comprising braces between said front legs.

5. A safety platform comprising:

a platform having an upper surface;

front legs each having an upper end, a medial section, and a lower end, whereby each said medial section is rotatingly attached to a front corner of said platform;

rear legs having an upper end, a medial section, and a lower end, said medial section further describing a longitudinal slot, whereby said longitudinal slot is slidingly connected to a rear corner of said platform;

lateral guard rails having a proximal end, a medial section, and a distal end, said medial section rotatingly connected to said upper end of each rear leg, and said distal end rotatingly connected to said upper end of each front leg;

linkages having an upper end and a lower end, said lower end rotatingly connected to each rear corner of said platform, and said upper end rotatingly connected to said proximal end of each guard rail, whereby the linkages, rear legs, and platform fold against said rear legs for storage; and a front guard rail connected between said pair of front legs.

6. The safety platform of claim 5, wherein said upper surface of said platform further comprises a high friction surface.

7. The safety platform of claim 5 further comprising steps ascending said rear legs to said platform.

8. The safety platform of claim 7 further comprising braces between said front legs.

9. A safety platform comprising:

a platform having an upper surface and two front corners and two rear corners;

a plurality of front legs each having an upper end, a medial section and a lower end, wherein said medial sections are rotatingly affixed to each of said front corners;

a plurality of rear legs having an upper end, a medial section and a lower end, said medial section each having a longitudinal slot, whereby each of said rear legs is slidingly attached to each of said rear corners of said platform by means of said longitudinal slot;

a plurality of lateral guard rails each having a proximal end, a medial section, and a distal end, wherein said proximal end is rotationally attached to said upper end of said rear leg, and said distal end is rotationally attached at said upper section of said front leg;

a plurality of linkages having an upper end and a lower end, whereby each lower end is rotationally attached to each of said rear corners of said platform and rotationally attached to said proximal end of said guard rails, thereby providing a means to fold the safety platform; and a front guard rail connected between said pair of front legs.

10. The safety platform as claimed in claim 9 wherein said upper surface of said platform further comprises a high-friction surface.

11. The safety platform as claimed in claim 9 further comprising steps connected between said rear legs.

12. The safety platform as claimed in claim 11 further comprising braces between said front legs.

* * * * *